US009950440B2

(12) United States Patent
Huang

(10) Patent No.: US 9,950,440 B2
(45) Date of Patent: Apr. 24, 2018

(54) PAPER PUNCH WITH ADJUSTABLE PUNCH SEATS

(71) Applicant: PAO SHEN ENTERPRISES CO., LTD., Chang Hua (TW)

(72) Inventor: Tsung-Wen Huang, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 85 days.

(21) Appl. No.: 15/240,021

(22) Filed: Aug. 18, 2016

(65) Prior Publication Data

US 2016/0354947 A1 Dec. 8, 2016

Related U.S. Application Data

(63) Continuation-in-part of application No. 14/066,981, filed on Oct. 30, 2013, now abandoned.

(30) Foreign Application Priority Data

Apr. 11, 2013 (TW) ..... 102206543 U

(51) Int. Cl.
*B26F 1/04* (2006.01)
*B26F 1/36* (2006.01)

(52) U.S. Cl.
CPC ..... *B26F 1/36* (2013.01); *Y10T 83/8828* (2015.04)

(58) Field of Classification Search
CPC ..... B26F 1/04; B26F 1/08; Y10T 83/8843; Y10T 83/8727
USPC ..... 83/549, 618
See application file for complete search history.

(56) References Cited

U.S. PATENT DOCUMENTS

| | | | | |
|---|---|---|---|---|
| 3,073,199 | A | 1/1963 | Yerkes | |
| 3,634,943 | A | 1/1972 | Parone | |
| 4,490,920 | A * | 1/1985 | Griset | B23B 47/28 33/32.3 |
| 6,785,977 | B1 | 9/2004 | Crichton | |
| 7,194,942 | B2 | 3/2007 | Lee | |
| 8,573,879 | B2 | 11/2013 | Chang | |
| 8,702,339 | B2 * | 4/2014 | Ballentine | F16B 7/1454 248/181.1 |
| 2002/0157517 | A1 | 10/2002 | Huang | |

FOREIGN PATENT DOCUMENTS

| | | | | |
|---|---|---|---|---|
| EP | 1741526 | A2 * | 1/2007 | B26D 7/2628 |

* cited by examiner

*Primary Examiner* — Andrea Wellington
*Assistant Examiner* — Fernando Ayala
(74) *Attorney, Agent, or Firm* — Bacon & Thomas, PLLC

(57) ABSTRACT

A paper punch includes a plurality of punch seats movably disposed along a slide board mounted on a base, a press board pivotably connected to the base to press punch heads of the punch seats, and a plurality of control members respectively disposed on the punch seats and operable to releasably lock the punch seats on the base. Each punch seat has a force transmitting member movably disposed on a die holder to transmit a pressing force of the press board so as to press the punch head downwardly to perform a firm and stable punching operation.

7 Claims, 10 Drawing Sheets

PAPER PUNCH WITH ADJUSTABLE PUNCH SEATS

CROSS-REFERENCE TO RELATED APPLICATION

This application is a continuation-in-part of U.S. patent application Ser. No. 14/066,981, filed by the applicant on Oct. 30, 2013, the entire disclosure of which is incorporated herein by reference.

This application further claims priority of Taiwanese Patent Application No. 102206543, filed on Apr. 11, 2013, the entire disclosure of which is incorporated herein by reference.

FIELD

The disclosure relates to a paper punch, and more particularly to a paper punch with movable punch seats for adjusting the distance between punch holes.

BACKGROUND

Recently, a paper punch having multiple movable punch seats for adjusting the distance between punch holes has been developed. Referring to FIG. 1, a conventional paper punch is shown to include multiple punch seats 70 (only one is shown) each having a frame 72 positioned on a base 60 by screwing a bolt 73 such that, by unscrewing the bolt 73 from the punch seat 70, the punch seat 70 is movable along a slide board 61 for adjusting the position of the punch seat 70. However, a tool is required, thereby rendering the adjusting operation inconvenient. Additionally, the punch seats 70 are not firmly positioned on the base 60. Moreover, during a punching operation, due to abutting engagement of a vertex portion 81 of a press board 8 with a punch head 71, a force (F1/F2) is applied to the punch head 71 and a horizontal force component thus generated causes deflection of the punch head 71 relative to the frame 72, thereby resulting in punching inaccuracy. On the other hand, the vertex portion 81 is liable to deformation and abrasion.

Therefore, in co-pending U.S. patent application Ser. No. 14/066,981, the applicant disclosed a paper punch which includes multiple punch seats each releasably locked on a slide board by means of a cam mechanism for readily unlocking the punch seat without using a tool.

In order to achieve a firm and stable punch operation, it is desirable to design a paper punch having a punch head not liable to deflection.

SUMMARY

Therefore, an object of the disclosure is to provide a paper punch that can alleviate at least one of the drawbacks of the prior art.

According to the disclosure, the paper punch includes a base having a guiding hole elongated in a longitudinal direction. An elongated slide board is disposed on the base and rearwardly of the guiding hole, and extends in the longitudinal direction. The slide board has a front positioning surface and a rear positioning surface extending in the longitudinal direction and disposed proximate to and distal from the guiding hole, respectively. A press board is pivotably connected to the base at a pivot end thereof and extends rearwardly to terminate at an effort end. The press board has a press portion interposed between the pivot end and the effort end and extending downwardly. Each of a plurality of punch seats has a die holder movably disposed on the base in the longitudinal direction, a punch head disposed on and movable relative to the die holder in an upright direction, a force transmitting member disposed between the press portion and the punch head to transmit a pressing force generated as a result of turning of the press board so as to press the punch head downwardly, and a biasing member disposed to bias the punch head upwardly. The die holder has a housing for the punch head to be movably accommodated therein, an extending arm extending rearwardly from the housing and defining therein a receiving space, and an anchoring portion extending downwardly from the housing and slidably engaged with the guiding hole. The housing has a rear abutting surface facing the front positioning surface of the slide board. The extending arm has a lower arm portion configured to cooperate with the housing to define an opening for insertion of the slide board. The housing has front and rear barrier portions spaced apart from each other to define a guiding channel therebetween. The force transmitting member has a thrust wall disposed above the punch head to be thrust by the pressing force, a connecting leg extending downwardly from the thrust wall and slidably disposed in the guiding channel, and a fastener disposed to fasten the connecting leg to the punch head so as to move the punch head downwardly along with a sliding movement of the force transmitting member along the guiding channel. The thrust wall has a cross-section larger than that of the punch head. Each of a plurality of control members is disposed on the die holder, and has a pivot pin disposed in the receiving space of the extending arm, and an eccentric seat eccentrically journalled on the pivot pin. The eccentric seat has an outer contour including first and second faces which are angularly displaced from each other about the pivot pin and which are proximate to and distal from the pivot pin, respectively, such that the eccentric seat is turnable relative to the extending arm between a locked position, where the first face is abutted tightly against the rear positioning surface of the slide board to generate a thrust force that permits the rear abutting surface to abut tightly against the front positioning surface of the slide board, and an unlocked position, where the second face confronts the rear positioning surface to permit movement of the die holder relative to the base in the longitudinal direction.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
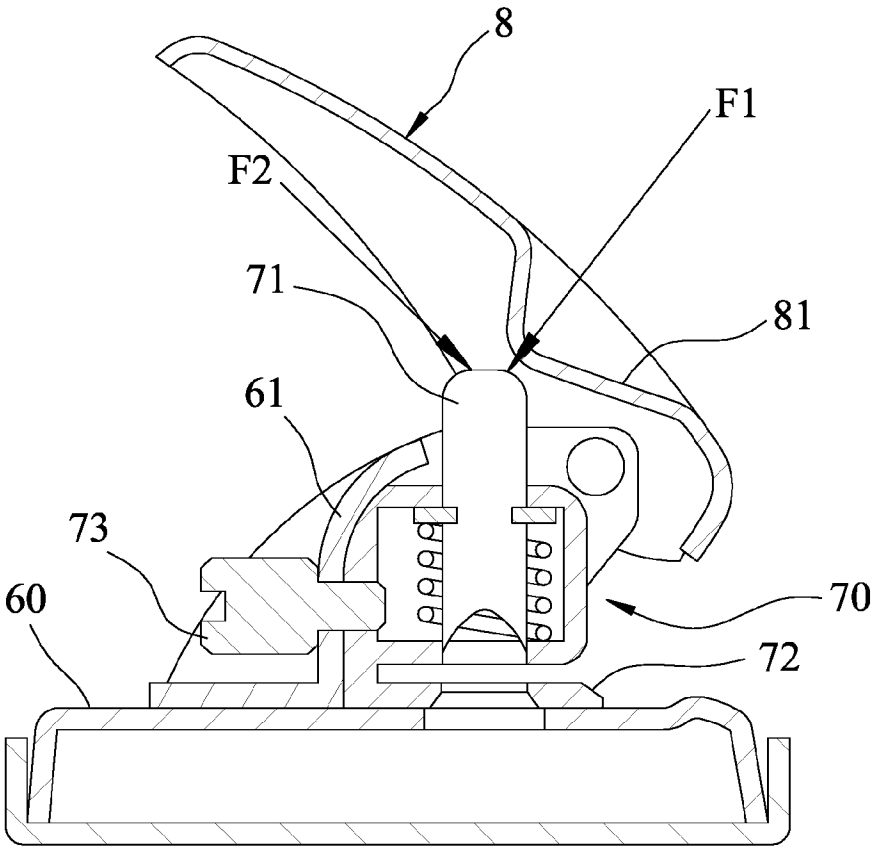
FIG.1 PRIOR ART
FIG. 1 is a sectional view of a conventional paper punch.
Figure 2:
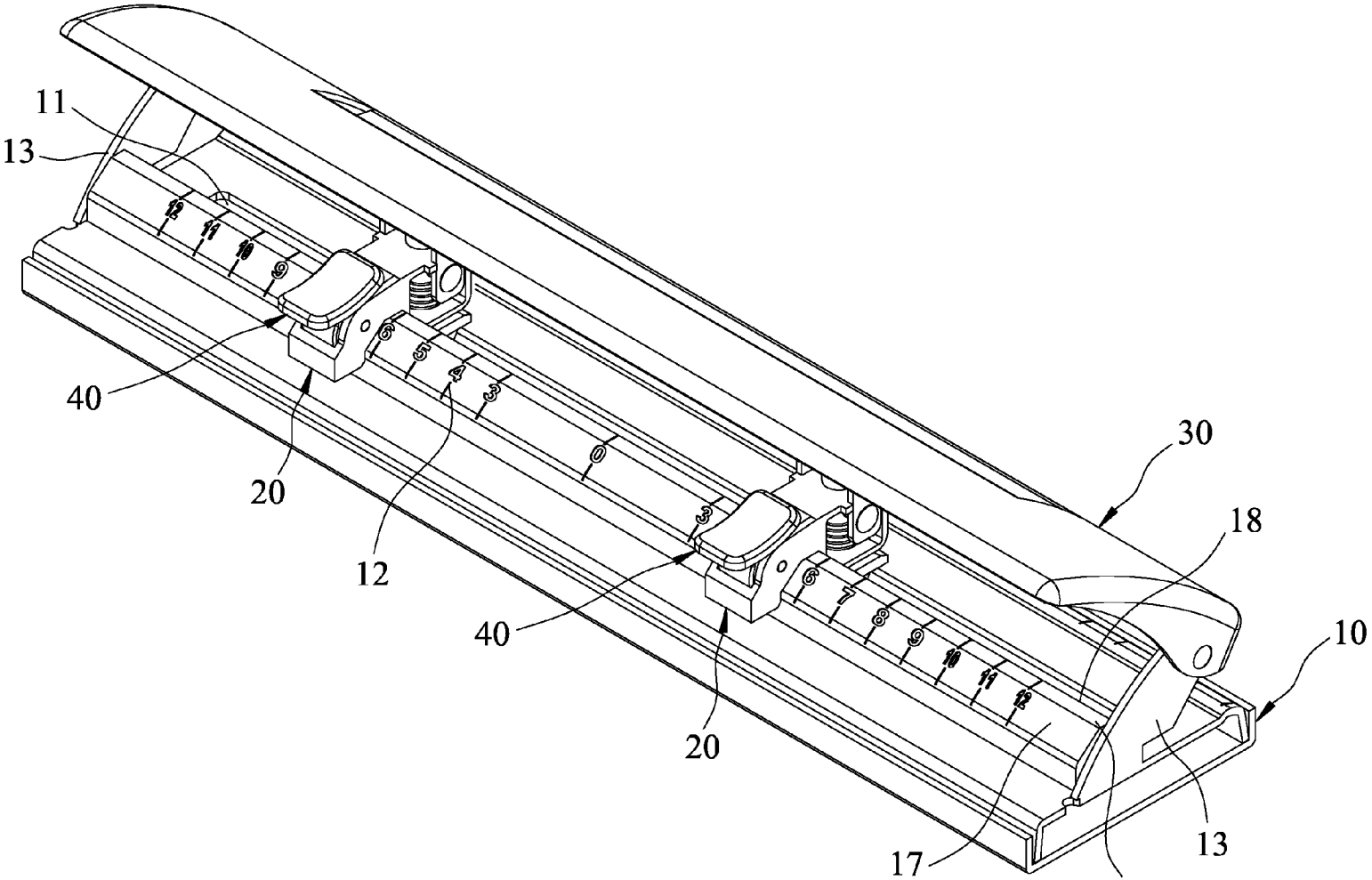
FIG. 2 is a perspective view illustrating an embodiment of a paper punch according to the disclosure.

Referring to FIG. 2, an embodiment of a paper punch according to this disclosure is shown to include a base 10, a press board 30, a plurality of punch seats 20 (two punch seats in this disclosure) and a plurality of control members 40 (two control members in this disclosure).

With reference to FIGS. 2 to 5, the base 10 has a guiding hole 11 elongated in a longitudinal direction. Two support arms 13 extend upwardly from the base 10 and are spaced apart from each other in the longitudinal direction for supporting a slide board 15 therebetween. The elongated slide board 15 is disposed on the base 10 and rearwardly of the guiding hole 11, and extends in the longitudinal direction. An index area 12 is defined on the slide board 15. The slide board 15 has a front positioning surface 18 and a rear positioning surface 17 extending in the longitudinal direction and disposed proximate to and distal from the guiding hole 11, respectively. The slide board 15 has a non-circular cross-section. The front positioning surface 18 stands in an upright direction.

The press board 30 is elongated and is pivotably connected to the support arms 13 at a pivot end 32 thereof. The press board 30 extends rearwardly to terminate at an effort end 33, and has a press portion 31 interposed between the pivot end 32 and the effort end 33 and extending downwardly.

Each of the punch seats 20 has a die holder 200 movably disposed on the base 10 in the longitudinal direction, a punch head 22 disposed on and movable relative to the die holder 200 in the upright direction, a force transmitting member 26 disposed between the press portion 31 and the punch head 22 to transmit a pressing force generated as a result of turning of the press board 30 so as to press the punch head 22 downwardly, and a biasing member 27 disposed to bias the punch head 22 upwardly.

The die holder 200 has a housing 21 located corresponding to the guiding hole 11 of the base 10 for the punch head 22 to be movably accommodated therein, an extending arm 24 extending rearwardly from the housing 21 and defining therein a receiving space 241, and an anchoring portion 25 extending downwardly from the housing 21 and slidably engaged with the guiding hole 11. By the engagement of the anchoring portion 25 with the guiding hole 11, removal of the punch seat 20 from the base 10 is prevented. Specifically, the housing 21 has an upper housing wall 210 extending normal to the upright direction, a lower housing wall 211 spaced apart from the upper housing wall 210 in the upright direction, front and rear housing walls 212, 213 interconnecting the upper and lower housing walls 210, 211 to cooperatively define an accommodation space for the punch head 22 and the biasing member 27, and an engaging wall 214 extending forwardly from the rear housing wall 213 and disposed under the lower housing wall 211 to be mounted on the base 10. The upper and lower housing walls 210, 211 and the engaging wall 214 have apertures 23 aligned with each other to define a punch stroke for the punch head 22. The upper housing wall 210 has two lateral edges which are opposite to each other in the longitudinal direction and each of which is recessed in the longitudinal direction to define a guiding channel 218. The guiding channel 218 extends in a front-and-rear direction to terminate at front and rear faces 219, 220 that serve as front and rear barrier portions, respectively. The rear housing wall 213 stands in the upright direction and has a rear side surface formed with a rear abutting surface 221 to face the front positioning surface 18 of the slide board 15.

The extending arm 24 has a lower arm portion configured to cooperate with the housing 21 to define an opening 242 for insertion of the slide board 15. The lower arm portion of the extending arm 24 has a lower wall surface which borders the opening 242 and which is configured complementary with the slide board 15 to be non-rotatably coupled with the slide board 15.

Referring to FIGS. 3 to 6, the force transmitting member 26 has a thrust wall 261 disposed above the punch head 22 to be thrust by the pressing force, a pair of connecting legs 262 extending downwardly from two sides of the thrust wall 261 and slidably disposed in the guiding channels 218, respectively, and a fastener 263 disposed to fasten the connecting legs 262 to the punch head 22 so as to move the punch head 22 downwardly along with a sliding movement of the force transmitting member 26 along the guiding channels 218. The thrust wall 261 has a cross-section larger than that of the punch head 22. In this embodiment, the thrust wall 261 is configured to extend in the front-and-rear direction to terminate at front and rear extending wall segments 265, 266 that are disposed forwardly and rearwardly of the punch head 22, respectively. The front extending wall segment 265 is configured to curve downwardly, and the rear extending wall segment 266 is configured to extend horizontally.

Figure 3:
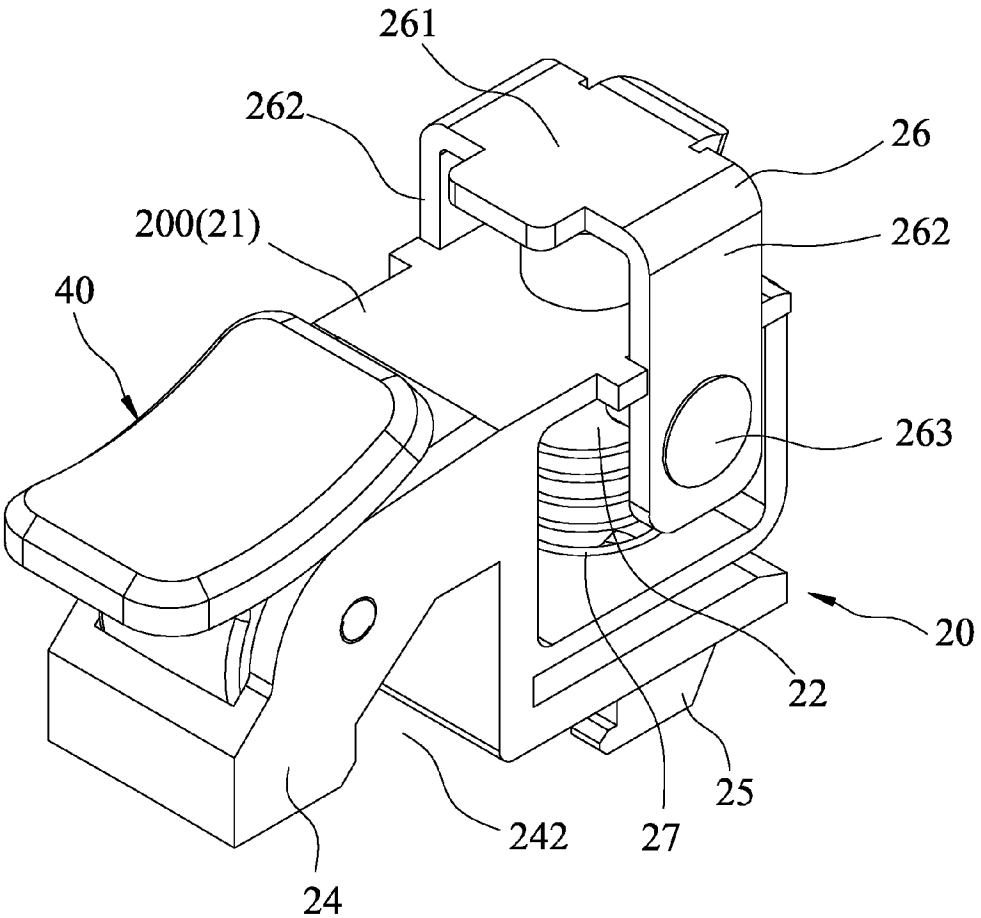
FIG. 3 is a perspective view illustrating a punch seat and a control member of the embodiment.
Figure 4:
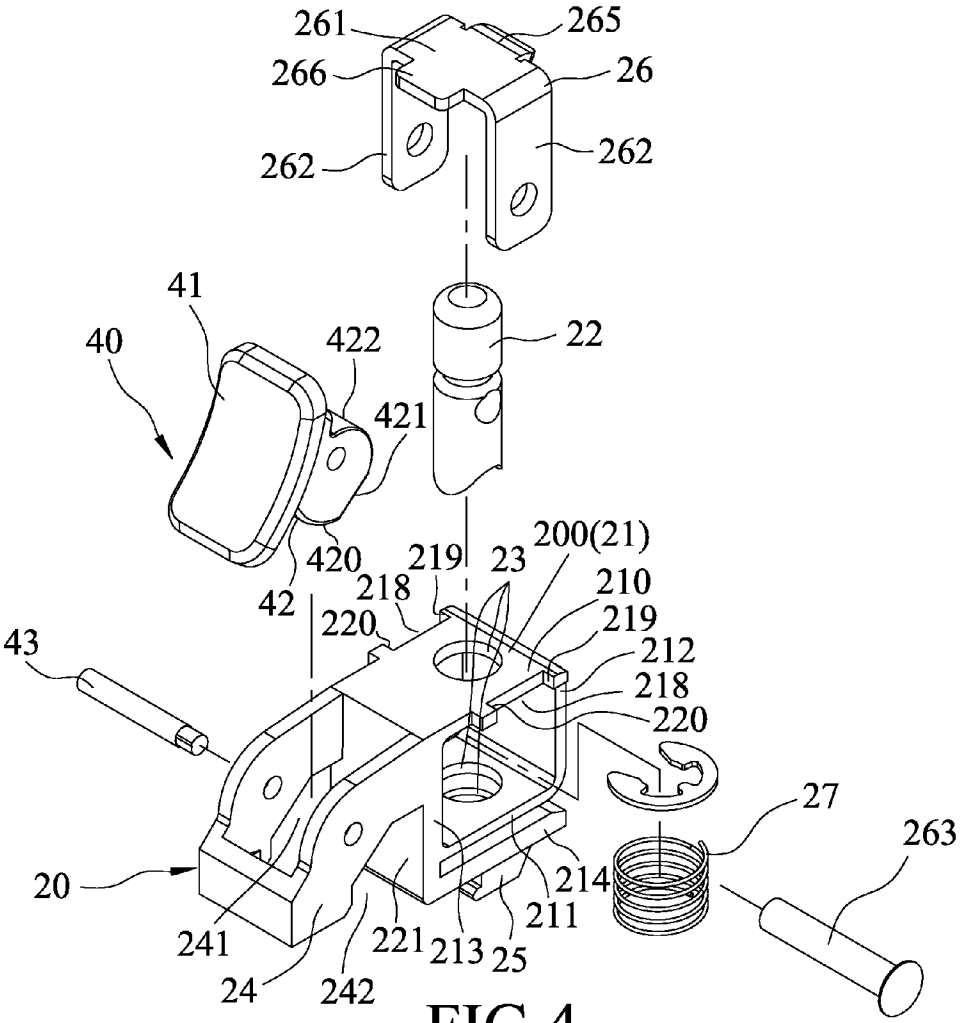
FIG. 4 is an exploded perspective view illustrating the punch seat and the control member.
Figure 5:
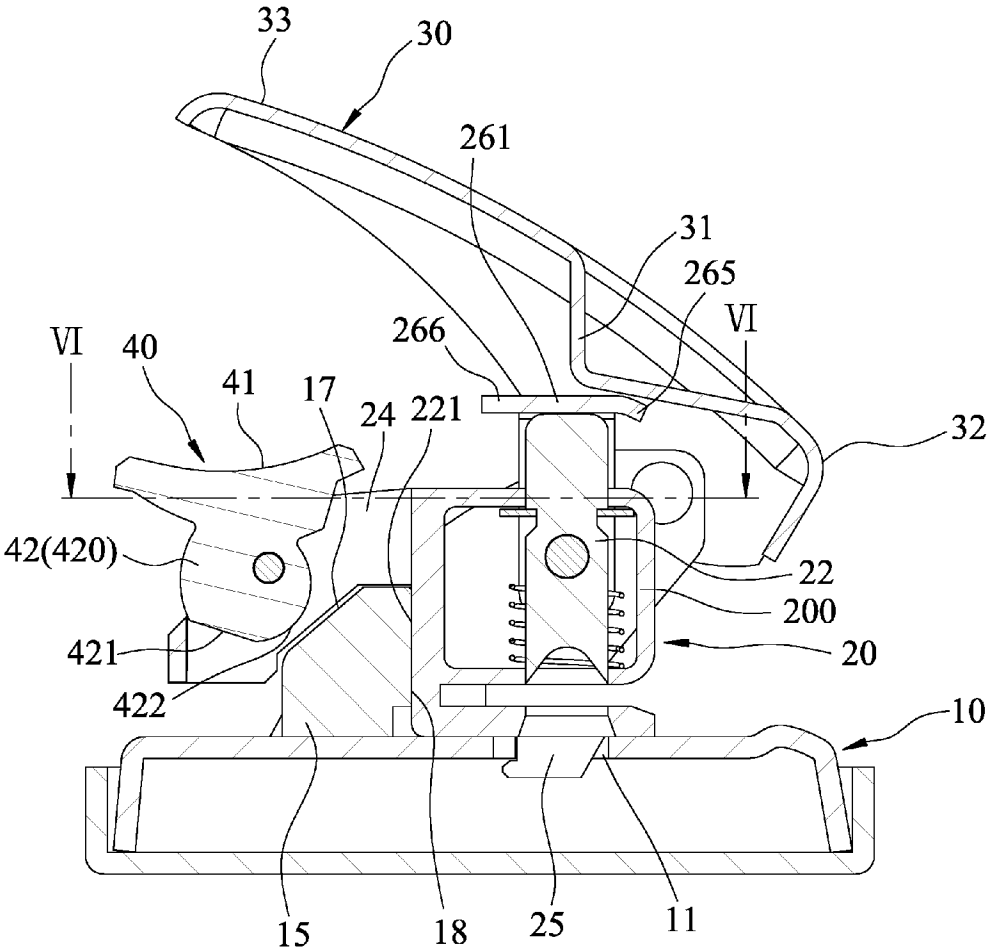
FIG. 5 is a sectional view illustrating a state where an eccentric seat of the control member is in an unlocked position.
Figure 6:
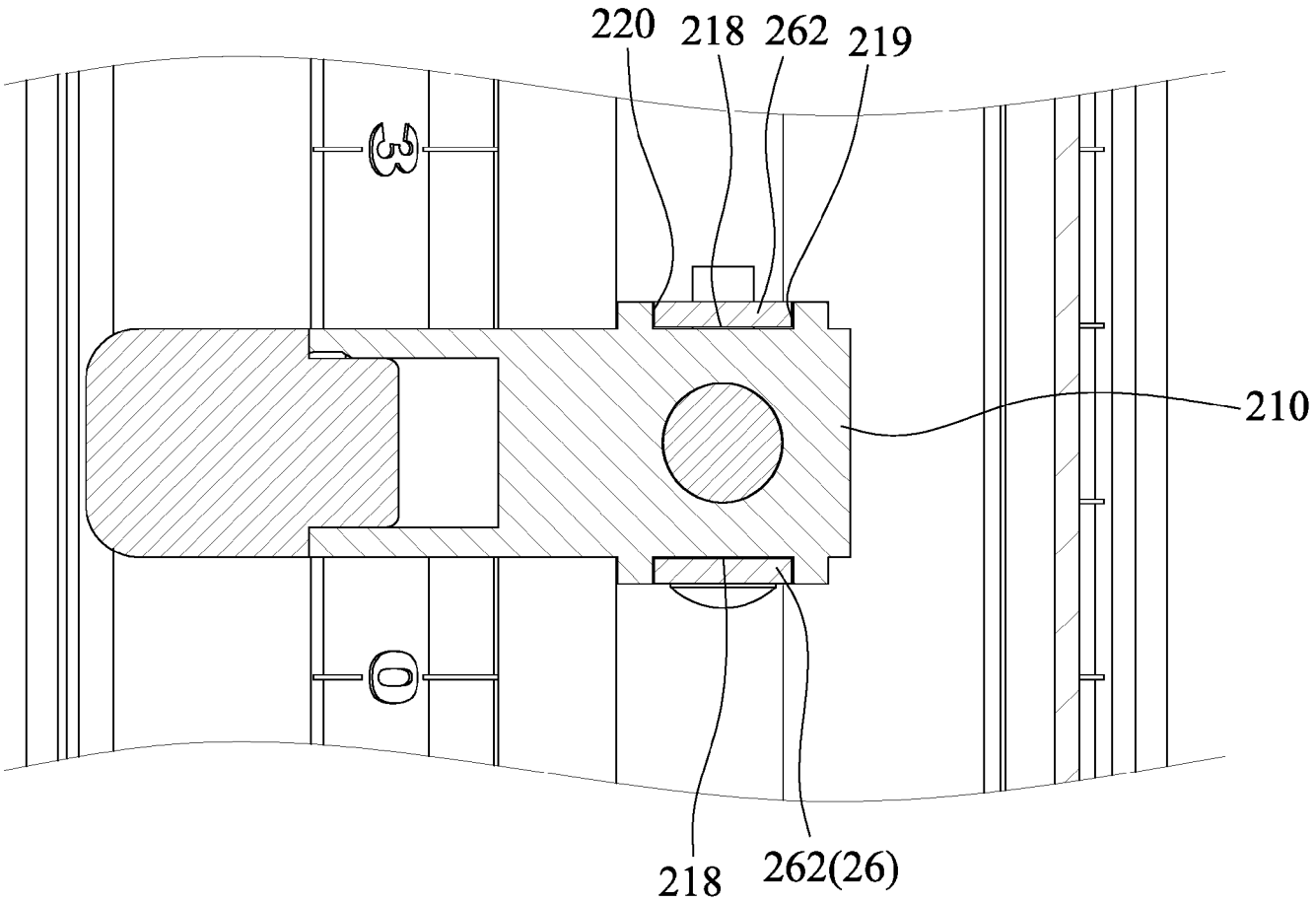
FIG. 6 is a sectional view taken along line VI-VI of FIG. 5.

Referring to FIGS. 3 to 5, each of the control members 40 is disposed on the die holder 200, and has a pivot pin 43 disposed in the receiving space 241 of the extending arm 24 and extending in the longitudinal direction, and an eccentric seat 42 eccentrically journalled on the pivot pin 43. The eccentric seat 42 has a seat portion 420 and an operating portion 41. The seat portion 420 has an outer contour including a flat first face 421 and an arcuate second face 422 which are angularly displaced from each other about the pivot pin 43 and which are proximate to and distal from the pivot pin 43, respectively. Thus, the eccentric seat 42 is turnable relative to the extending arm 24 between a locked position (see FIG. 7), where the first face 421 is abutted tightly against the rear positioning surface 17 of the slide board 15 to generate a thrust force that permits the rear abutting surface 221 of the housing 21 to abut tightly against the front positioning surface 18 of the slide board 15, and an unlocked position (see FIG. 5), where the second face 422 confronts the rear positioning surface 17 to permit movement of the die holder 200 relative to the base 10 along the slide board 15 in the longitudinal direction. Each of the front positioning surface 18 of the slide board 15 and the rear abutting surface 221 of the housing 21 stands in the upright direction so as to facilitate transmission of the thrust force to the housing 21 when the eccentric seat 42 is turned to the locked position, thereby ensuring firm and stable retaining of the punch seat 20 on the base 10.

Figure 7:
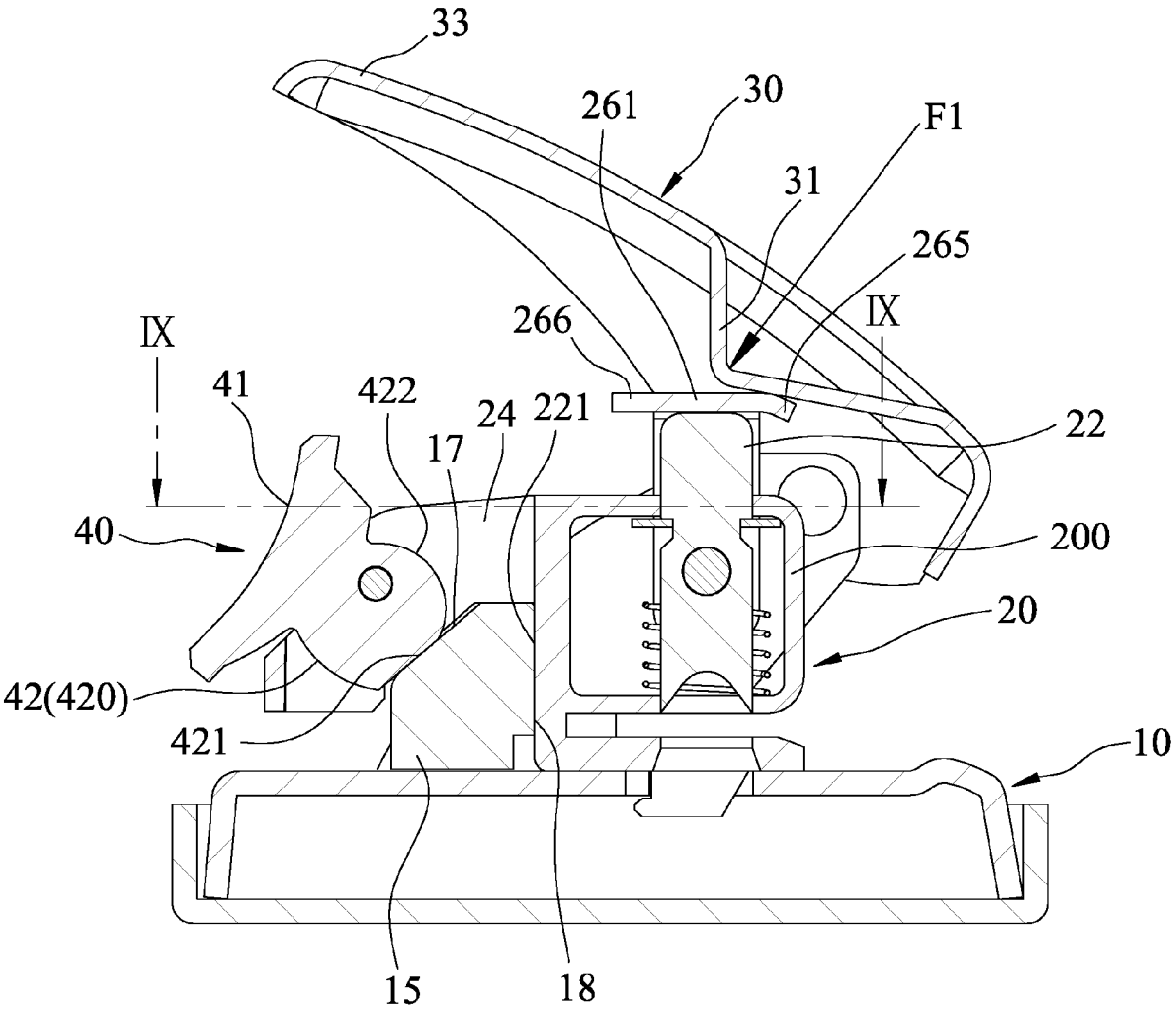
FIG. 7 is a sectional view illustrating a state where the eccentric seat is in a locked position and a press board is in an initial operating position.
Figure 8:
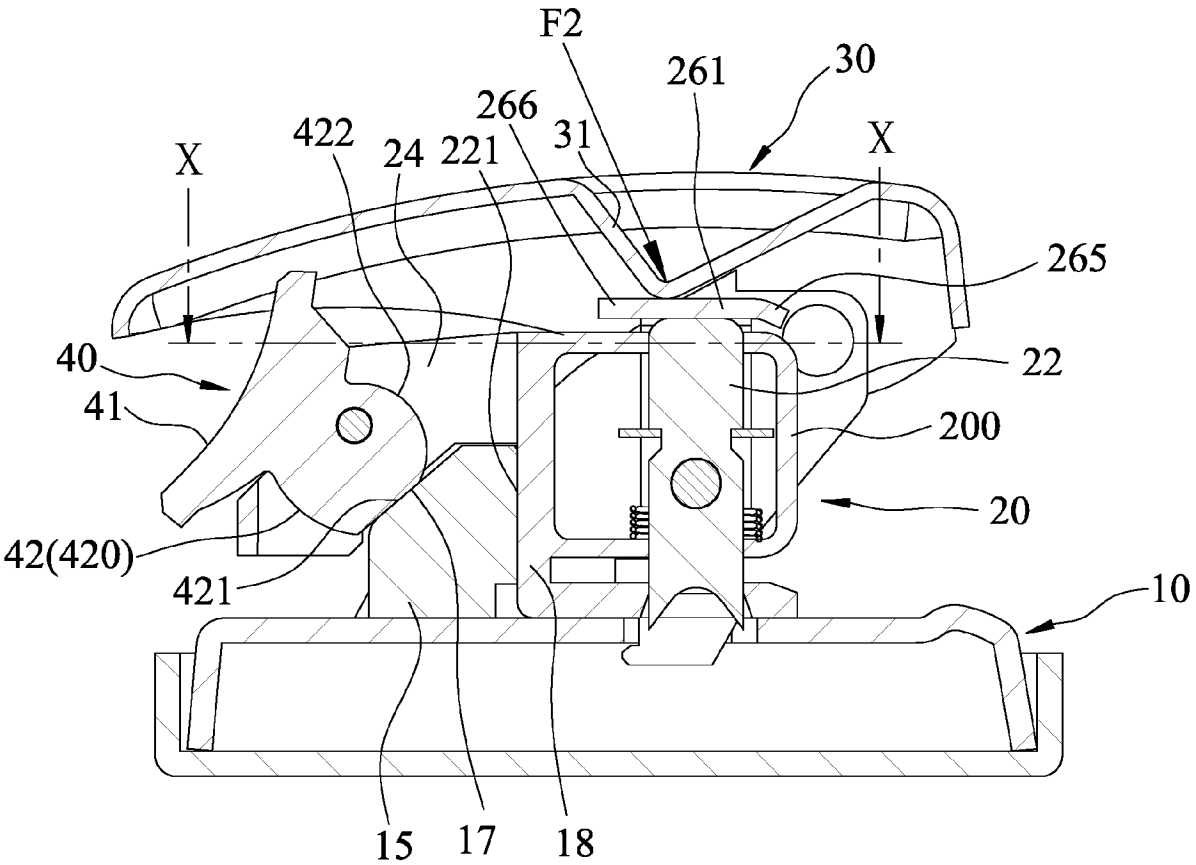
FIG. 8 is a sectional view illustrating a state where the eccentric seat is in the locked position and the press board is in a final operating position.

Referring to FIGS. 7 and 8, in a punching operation, the eccentric seat 42 of each punch seat 20 is in the locked position, and the press board 30 is turned by pressing the effort end 33 from an initial operating position (see FIG. 7), where the press portion 31 of the press board 30 abuts against the thrust wall 261 in proximity with the front extending wall segment 265 to apply a force (F1) to the force transmitting member 26, to a final operating position (see FIG. 8), where the pressing portion 31 abuts against the thrust wall 261 in proximity with the rear extending wall segment 266 to apply a force (F2) to the force transmitting member 26. The punch head 22 is moved downwardly along with the movement of the force transmitting member 26 for punching holes.

Figure 9:
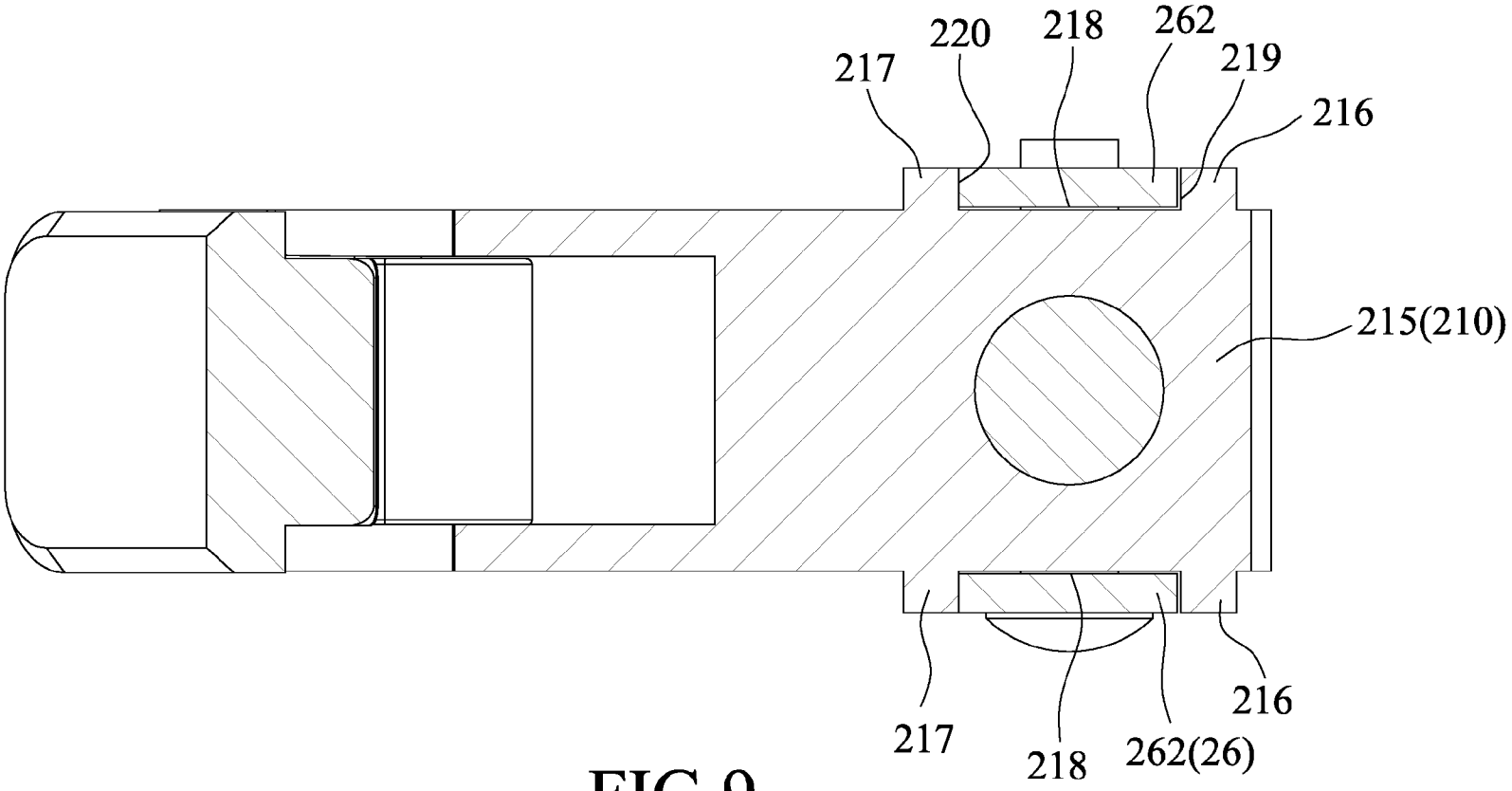
FIG. 9 is a sectional view taken along line IX-IX of FIG. 7.
Figure 10:
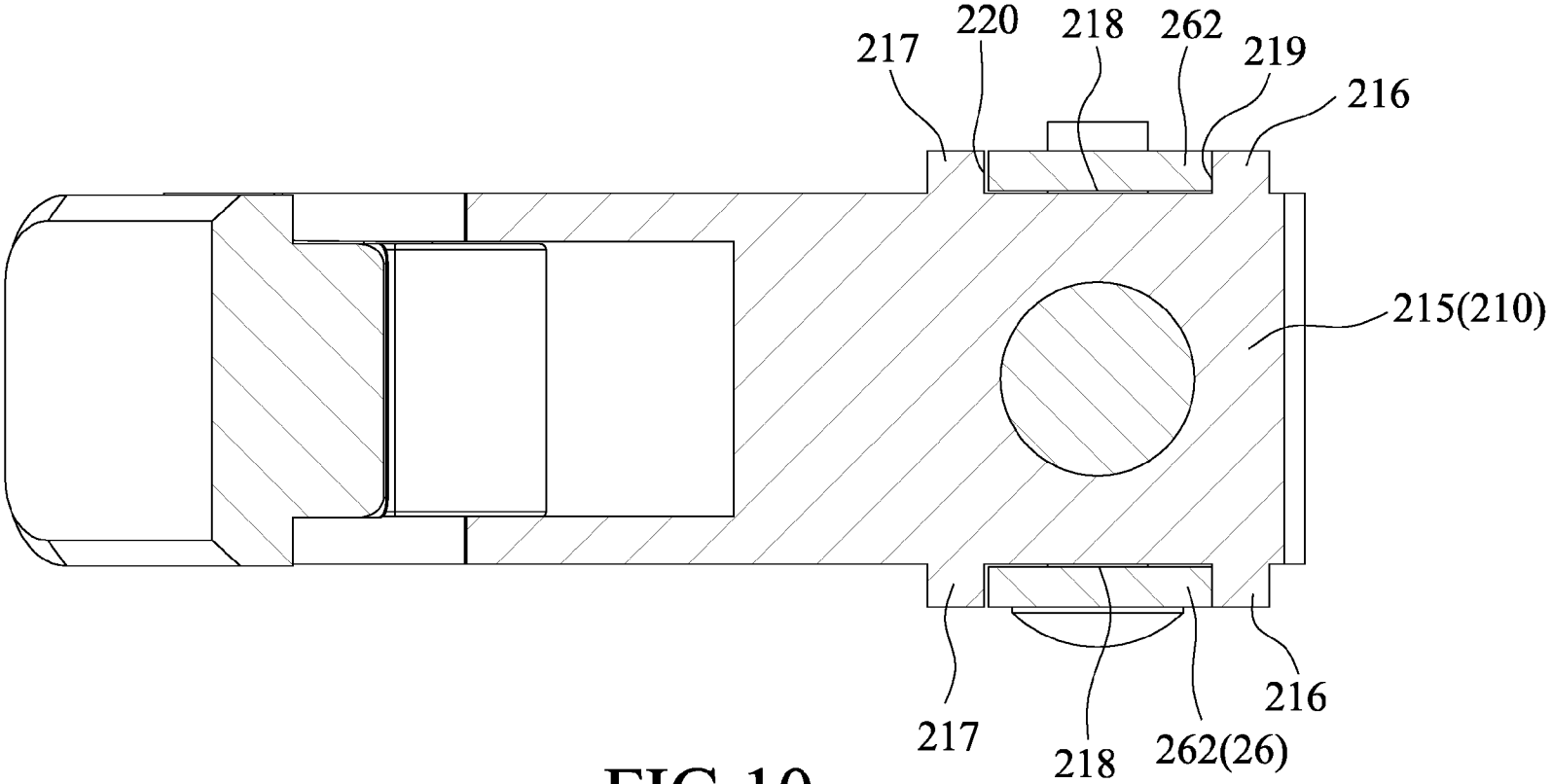
FIG. 10 is a sectional view taken along line X-X of FIG. 8.

As illustrated in FIGS. 7 and 9, when the press board 30 is in the initial operating position, the horizontal force component of the force (F1) presses the force transmitting member 26 rearwardly, while the connecting legs 262 abut against the rear barrier portions (i.e. the rear faces 220) to prevent further reward movement of the force transmitting member 26. Referring to FIGS. 8 and 10, when the press board 30 is turned to the final operating position, the horizontal force component of the force (F2) presses the force transmitting member 26 forwardly, while the connecting legs 262 abut against the front barrier portions (i.e. the front faces 219) to prevent further forward movement of the force transmitting member 26. Thus, during the punching operation, the pressing force can be successfully transmitted to the punch head 22 through the force transmitting member 26. Any undesired horizontal movement of the force transmitting member 26 and the punch head 22 possibly caused by the horizontal force components of the force (F1) and the force (F2) is prevented by the abutment of the connecting legs 262 against the front and rear barrier portions, such that deflection of the punch head 22 can be avoided to perform a firm and stable punch operation. Besides, the cross-section of the thrust wall 261 has an area larger than that of the cross-section of the punch head 22, such that the thrust wall 261 has a relatively large contact area with the press portion 31 of the press board 30, which diminishes the counteracting force to the press portion 31 so as to reduce the risk of deforming and wearing the press portion 31.

While the disclosure has been described in connection with what is considered the exemplary embodiment, it is understood that this disclosure is not limited to the disclosed embodiment but is intended to covervarious arrangements included within the spirit and scope of the broadest interpretation so as to encompass all such modifications and equivalent arrangements.

What is claimed is:

1. A paper punch comprising:

a base having a guiding hole elongated in a longitudinal direction;

an elongated slide board disposed on said base and rearwardly of said guiding hole and extending in the longitudinal direction, said slide board having a front positioning surface and a rear positioning surface extending in the longitudinal direction and wherein said front positioning surface and said rear positioning surface of said slide board are disposed proximate to and distal from said guiding hole, respectively;

a press board pivotably connected to said base at a pivot end thereof and extending rearwardly to terminate at an effort end, said press board having a press portion interposed between said pivot end and said effort end and extending downwardly;

a plurality of punch seats, each having a die holder which is movably disposed on said base in the longitudinal direction, a punch head which is disposed on and movable relative to said die holder in an upright direction, a force transmitting member which is disposed between said press portion and said punch head to transmit a pressing force generated as a result of turning of said press board so as to press said punch head downwardly, and a biasing member which is disposed to bias said punch head upwardly, said die holder having a housing for said punch head to be movably accommodated therein, an extending arm extending rearwardly from said housing and defining therein a receiving space, and an anchoring portion extending downwardly from said housing and slidably engaged with said guiding hole, said housing having a rear abutting surface facing said front positioning surface of said slide board, said extending arm having a lower arm portion configured to cooperate with said housing to define an opening for insertion of said slide board, said housing having front and rear barrier portions spaced apart from each other to define a guiding channel therebetween, said force transmitting member having a thrust wall disposed above said punch head to be thrust by the pressing force, a connecting leg extending downwardly from said thrust wall and slidably disposed in said guiding channel, and a fastener disposed to fasten said connecting leg to said punch head so as to move said punch head downwardly along with a sliding movement of said force transmitting member along said guiding channel, said thrust wall having a cross-section larger than that of said punch head; and a plurality of control members, each disposed on said die holder, each of said control members having a pivot pin disposed in said receiving space of said extending arm, and an eccentric seat eccentrically journalled on said pivot pin, said eccentric seat having an outer contour including first and second faces which are angularly displaced from each other about said pivot pin and which are proximate to and distal from said pivot pin, respectively, such that said eccentric seat is turnable relative to said extending arm between a locked position, where said first face is abutted tightly against said rear positioning surface of said slide board to generate a thrust force that permits said rear abutting surface to abut tightly against said front positioning surface of said slide board, and an unlocked position, where said second face confronts said rear positioning surface to permit movement of said die holder relative to said base in the longitudinal direction.

2. The paper punch as claimed in claim 1, wherein said housing of said die holder has an upper housing wall extending normal to the upright direction and having a lateral edge which is recessed in the longitudinal direction to define said guiding channel, said guiding channel extending in a front-and-rear direction to terminate at front and rear faces that serve as said front and rear barrier portions, respectively.

3. The paper punch as claimed in claim 2, wherein said housing of said die holder further has a lower housing wall spaced apart from said upper housing wall in the upright direction, and front and rear housing walls interconnecting said upper and lower housing walls to cooperatively define an accommodation space for said punch head and said biasing member, said upper and lower housing walls having apertures aligned with each other to define a punch stroke for said punch head, said rear abutting surface being formed on a rear side surface of said rear housing wall.

4. The paper punch as claimed in claim 3, wherein said thrust wall of said force transmitting member is configured to extend in the front-and-rear direction to terminate at front and rear extending wall segments that are disposed forwardly and rearwardly of said punch head, respectively, such that said press board being turnable between an initial operating position, where said press portion abuts against said thrust wall in proximity with said front extending wall segment, and a final operating position, where said pressing portion abuts against said thrust wall in proximity with said rear extending wall segment.

5. The paper punch as claimed in claim 4, wherein said front extending wall segment is configured to curve downwardly, and said rear extending wall segment is configured to extend horizontally.

6. The paper punch as claimed in claim 1, further comprising two support arms extending upwardly from said base and spaced apart from each other in the longitudinal direction for supporting said slide board therebetween.

7. The paper punch as claimed in claim 1, wherein said lower arm portion of said extending arm has a lower wall surface which borders said opening and which is configured to be complementary with said slide board to be non-rotatably coupled with said slide board, each of said front positioning surface of said slide board and said rear abutting surface of said housing standing in the upright direction so as to permit transmission of the thrust force to said housing when said eccentric seat is turned to the locked position.

* * * * *